US006964584B2

(12) United States Patent
Zhong et al.

(10) Patent No.: US 6,964,584 B2
(45) Date of Patent: Nov. 15, 2005

(54) LOW IMPEDANCE, HIGH-POWER SOCKET AND METHOD OF USING

(75) Inventors: Dong Zhong, Chandler, AZ (US); Yuan-Liang Li, Chandler, AZ (US); David G. Figueroa, Mesa, AZ (US); Jiangqi He, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 225 days.

(21) Appl. No.: 10/032,377

(22) Filed: Dec. 21, 2001

(65) Prior Publication Data

US 2003/0119341 A1 Jun. 26, 2003

(51) Int. Cl.[7] ..... H01R 13/66
(52) U.S. Cl. ..... 439/620
(58) Field of Search ..... 439/70, 71, 69, 439/620

(56) References Cited

U.S. PATENT DOCUMENTS 3,880,493 A * 4/1975 Lockhart, Jr.
4,072,380 A * 2/1978 Freehauf
4,328,530 A * 5/1982 Bajorek et al.
4,500,159 A * 2/1985 Briones
4,519,658 A * 5/1985 Biswas
5,387,814 A * 2/1995 Baudouin
5,475,261 A * 12/1995 Tanizawa ..... 257/693
5,538,433 A * 7/1996 Arisaka ..... 439/70
5,779,502 A * 7/1998 Daftari et al. ..... 439/620
6,056,558 A * 5/2000 Lin et al. ..... 439/83
6,201,298 B1 * 3/2001 Sato et al. ..... 257/691
6,392,145 B1 * 5/2002 Andric ..... 174/52.4
6,441,419 B1 * 8/2002 Johnson et al. ..... 257/296
6,551,114 B2 * 4/2003 Andric et al. ..... 439/70

* cited by examiner

*Primary Examiner*—Neil Abrams
(74) *Attorney, Agent, or Firm*—Schwegman, Lundberg, Woessner & Kluth, P.A.

(57) ABSTRACT

The present invention relates to a power socket for a microelectronic device that, in one embodiment, uses a low-resistance power and ground terminal configuration. In another embodiment, a low-resistance power and ground terminal configuration is combined on the power socket with a vertically oriented interdigital capacitor that is used to lower inductance. By this combination a significantly lowered impedance is achieved during operation of the microelectronic device. The capacitor may include plates that are vertically oriented relative to the major planar surface of the socket faces and capacitors may be located between a power and a ground contact, between two power contacts, or between two ground contacts.

19 Claims, 8 Drawing Sheets

LOW IMPEDANCE, HIGH-POWER SOCKET AND METHOD OF USING

BACKGROUND OF THE INVENTION

1. Field of the Invention

The present invention relates to a microelectronic device power socket. More particularly, the present invention relates to a high-power socket for a microelectronic device such as a processor. In particular, the present invention relates to a low resistance path and optionally a low inductance path for power delivery through the socket.

2. Description of Related Art

Chip packaging requires high-power sockets for devices such as processors and application-specific integrated circuits (ASICs). A processor requires a high current to enable the multiple-gigahertz clock cycles that are being achieved and to enable the variety of logic and memory operations that are simultaneously being executed. High currents through sockets require low resistances in order to minimize power dissipation that is otherwise caused by resistance heating. Larger power dissipations in the socket result in higher socket temperatures, that in turn slow and ultimately defeat the device. Additionally a high inductance is often generated in the power socket. Overall, the impedance, the ratio of voltage to current also affects the performance of the microelectronic device. An unacceptably high impedance will degrade both the signal and increase the resistance heating. When such a heating problem occurs, processor speed is slowed, or worse, the device fails with the result of lost data and lost productivity.

One way to deal with the challenges created by high current draw is to use more input/output (I/O) pins for the current draw. This allows a larger cumulative cross-sectional area to carry the power current, but the result is added cost, and even more scarce I/O real estate on the footprint of the power socket. Further, where the number of pins added to the power dissipation load do not provide a significantly lowered resistance than the resistance of the pins in the more active regions of the processor, the effectiveness of the additional pins may not be sufficient to reduce the current flowing through a given region of the socket. Additionally, the added pins must provide an effective direct current (DC) shunt capability.

BRIEF DESCRIPTION OF THE DRAWINGS

In order that the manner in which embodiments of the present invention are obtained, a more particular description of the invention briefly described above will be rendered by reference to specific embodiments thereof which are illustrated in the appended drawings. Understanding that these drawings depict only typical embodiments of the invention that are not necessarily drawn to scale and are not therefore to be considered to be limiting of its scope, the invention will be described and explained with additional specificity and detail through the use of the accompanying drawings in which.

DETAILED DESCRIPTION OF THE INVENTION

The present invention relates to a power socket for a microelectronic device such as a processor. In one embodiment, a low resistance and low inductance path is provided for power delivery through the power socket to the processor or microelectronic device that is being serviced by the power socket.

The following description includes terms, such as upper, lower, first, second, etc. that are used for descriptive purposes only and are not to be construed as limiting. The embodiments of a device or article of the present invention described herein can be manufactured, used, or shipped in a number of positions and orientations. The terms "die" and "processor" generally refer to the physical object that is the basic workpiece that is transformed by various process operations into the desired integrated circuit. A die is typically made of semiconductive material that has been singulated from a wafer after integrated processing. Wafers may be made of semiconducting, non-semiconducting, or combinations of semiconducting and non-semiconducting materials.

Reference will now be made to the drawings wherein like structures will be provided with like reference designations. In order to show the structures of the present invention most clearly, the drawings included herein are diagrammatic representations of inventive articles. Thus, the actual appearance of the fabricated structures, for example in a photomicrograph, may appear different while still incorporating the essential structures of the present invention. Moreover, the drawings show only the structures necessary to understand the present invention. Additional structures known in the art have not been included to maintain the clarity of the drawings.

Figure 1:
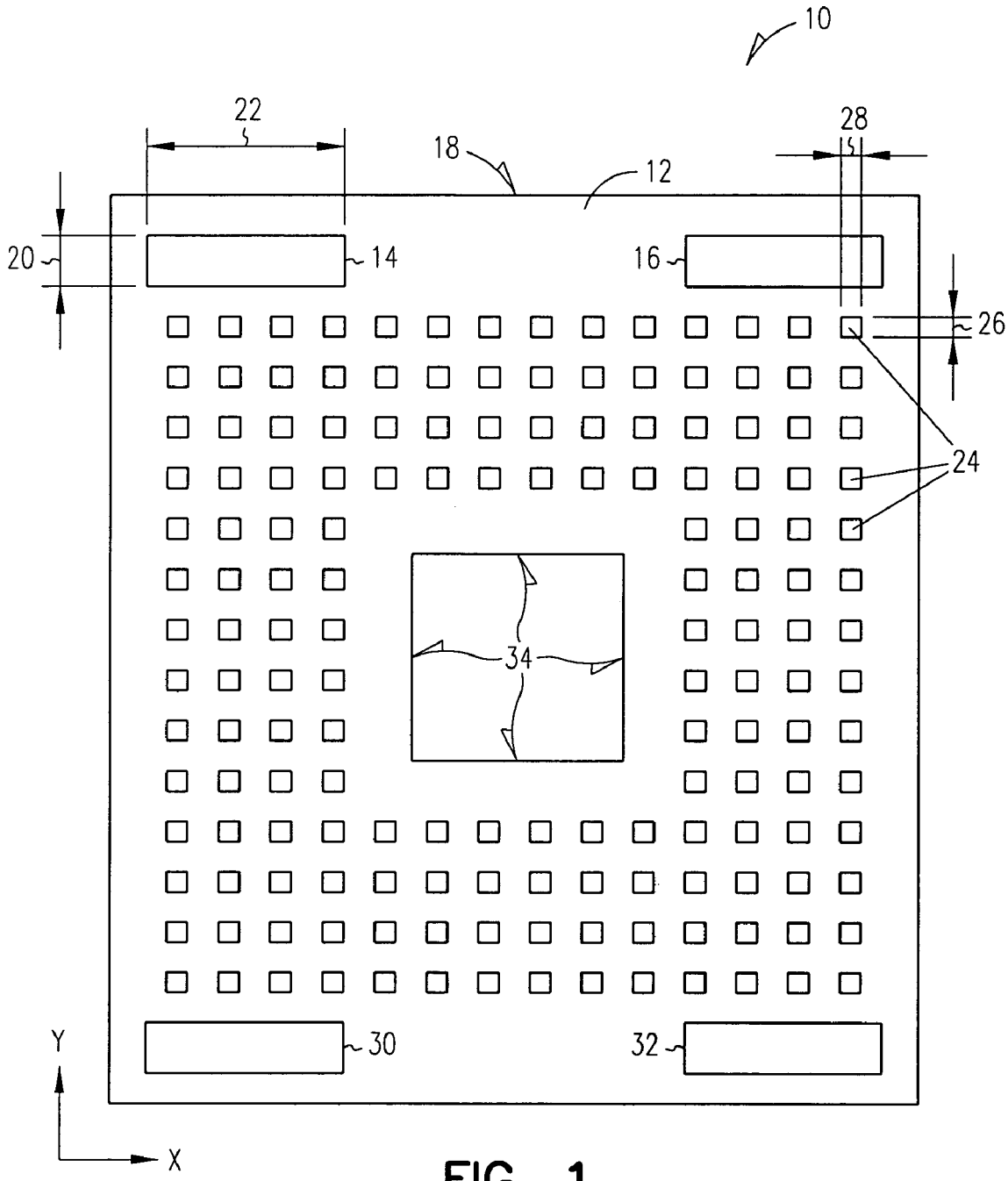
FIG. 1 is a top plan view of a high power socket according to an embodiment.

FIG. 1 illustrates a high-current power socket 10. The power socket 10 includes a socket platform 12 including a major planar surface that is depicted in the X-Y plane. A first power terminal 14 is disposed on the socket platform 12 and is spaced apart from a first ground terminal 16 along an upper edge 18. The first power terminal 14 includes a first cross-sectional area that is defined by a power terminal height 20 and a power terminal width 22. The power socket 10 also includes an input/output (I/O) pin socket 24 that includes a second cross-sectional area defined by an I/O pin socket height 26 and an I/O pin socket width 28. It is noted that the first cross-sectional area is larger than the second cross-sectional area. In one embodiment the ratio of the first cross-sectional area to the second cross-sectional area is from about 4:1 to about 50:1. In another embodiment, the ratio is from about 8:1 to about 40:1. In another embodiment, it is from about 16:1 to about 30:1. This cross-sectional area comparison may be a comparison of height 20 multiplied by the width 22, compared to the cross-sectional area of a pin (not pictured) that inserts into I/O pin socket 24 from a device such as an interposer (not pictured). The cross-sectional area may also be the surface area of contact within the locking mechanism (not pictured) within the I/O pin socket 24 as is known in the art.

In one embodiment, besides the first power terminal 14 and the first ground terminal 16, the power socket 10 includes a second power terminal 30 and a second ground terminal 32. Additionally in this embodiment as can be seen, a plurality of I/O pin sockets are provided that are substantially similar to the I/O pin socket 24. In addition to the structure of power socket 10, a center space 34 is provided in one embodiment for a power capacitor for delivering short-range power to the electronic device. In this embodiment, center space 34 is provided for a land-side capacitor (LSC).

FIG. 2 illustrates another embodiment of a power socket 110. In some applications, a lower inductance is desired during power delivery to an electronic device such as a general processor or an ASIC. The power socket 110 includes structures that are similar to the power socket 10 depicted in FIG. 1. A first power terminal 14 is disposed on a socket platform 112 and is spaced apart from a first ground terminal 16 along an upper edge 118. Additionally, a first plurality of I/O pin sockets 24 is provided.

Where the bulk of the power current supplied to the electronic device passes first through the power terminals 14 and 30, and passes to ground through the ground terminals 16 and 32, significant inductance may result for some applications. According to this embodiment, current is also allowed to pass through a capacitor structure as illustrated generically by item 136. The capacitor structure 136 is oriented such that its capacitative surfaces (e.g. capacitor plates) are arranged orthogonal to the X-Y plane. In other words, the capacitor plates are vertically oriented to the major planar surface. In one embodiment, the capacitor structure 136 includes an inter-digital capacitor (illustrated in various embodiments in FIGS. 3 and 4). The inter-digital capacitor includes capacitor plates that are vertically (orthogonally) oriented to the major planar surface that is defined by the X-Y plane. Optionally and additionally, a second capacitor 138 that may be an inter-digital capacitor is disposed between second power terminal 30 and second ground terminal 32 at a lower edge 140 of power socket 110.

Figure 2A:
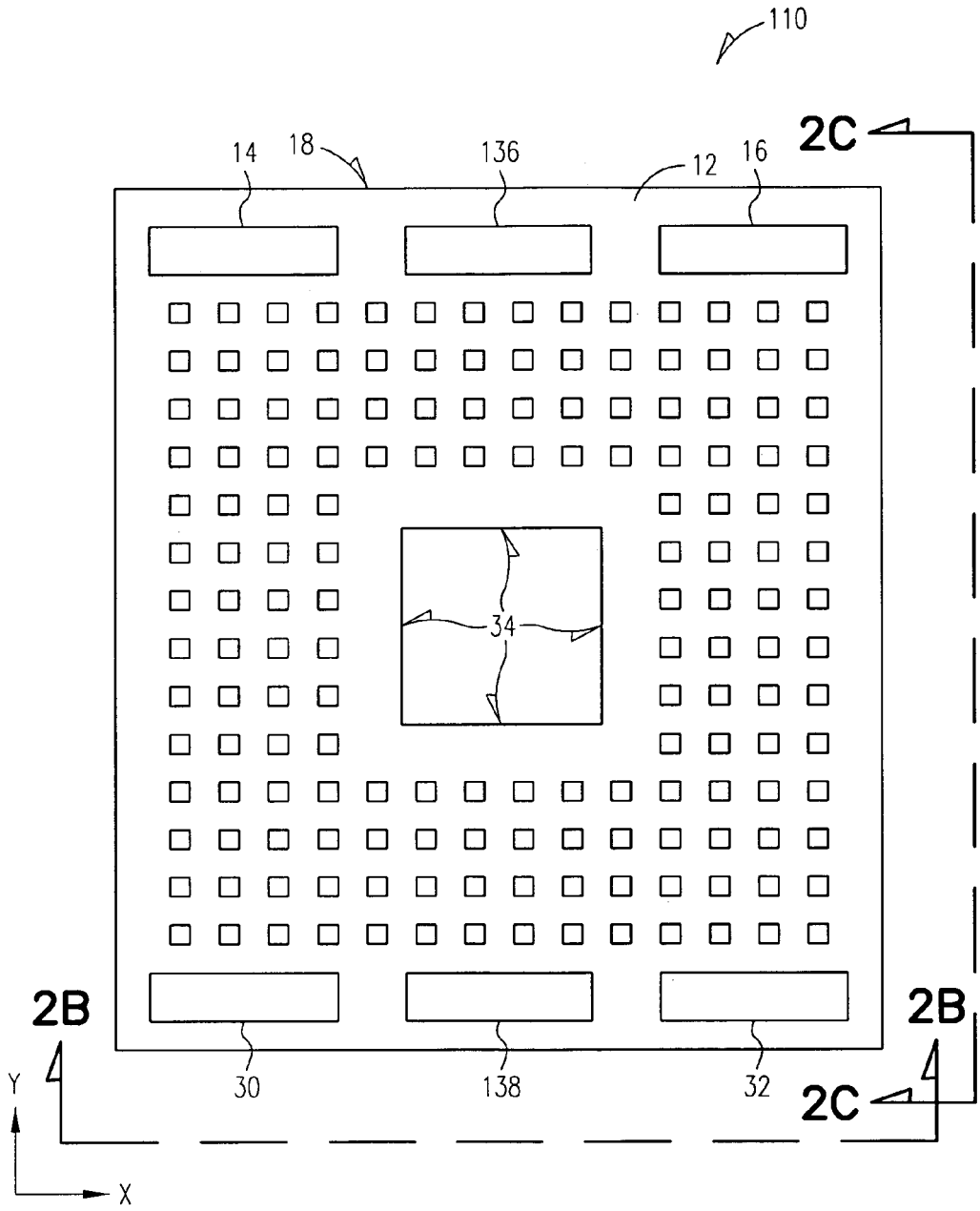
FIG. 2A is a top plan view of a high power socket according to an embodiment.
Figure 2B:
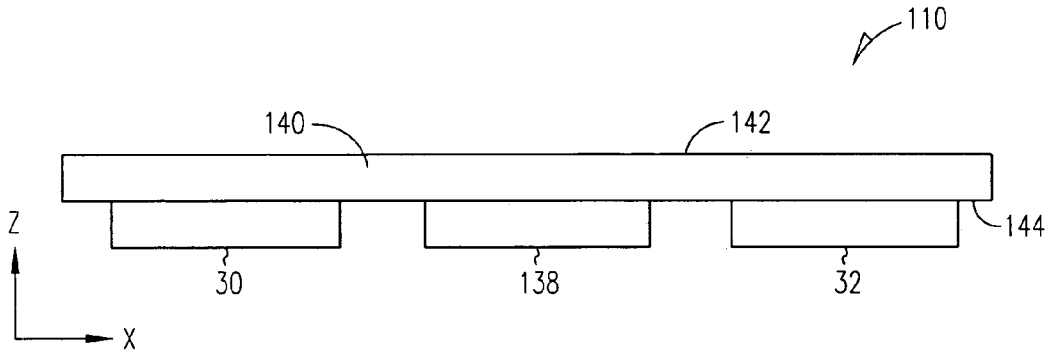
FIG. 2B is an elevational view of the socket depicted in FIG. 2A.

FIG. 2B is an elevational view of power socket 110, taken along the line 2B—2B from FIG. 2A. Power socket 110 in this view includes a major planar upper surface 142 and a major planar lower surface 144. FIG. 2B illustrates that both power 30 and ground 32 terminals extend below major planar lower surface 144, as well as second capacitor 138. The degree to which the power and ground terminals as well as the capacitor(s) extend below major planar lower surface 144 is often determined by a specific application of the embodiment.

Figure 2C:
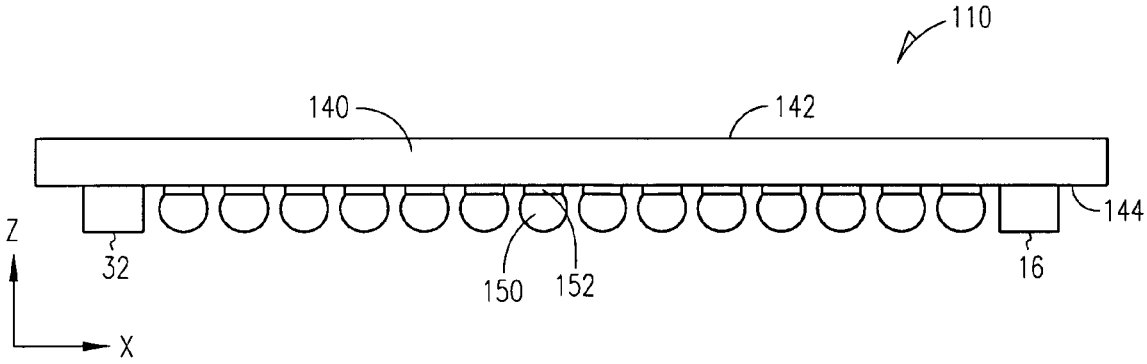
FIG. 2C is an elevational view of the socket depicted in FIG. 2A.

FIG. 2C is an elevational view of power socket 110, taken along the line 2C—2C from FIG. 2A. Power socket 110 in this view includes the major planar upper surface 142 and the major planar lower surface 144. FIG. 2C illustrates that both ground terminals 32 and 16 as they extend below major planar lower surface 144. FIG. 2C also illustrates a second plurality of electrical bumps 150 disposed at the major planar lower surface 144. In one embodiment, the bumps 150 are mounted on a bond pad 152. In one embodiment, the bond pad 152 is set flush (not pictured) with the major planar lower surface 144. In one embodiment, the second plurality of electrical bumps 150 is equal to the first plurality of I/O pin sockets 24, depicted in FIG. 2A.

Figure 3:
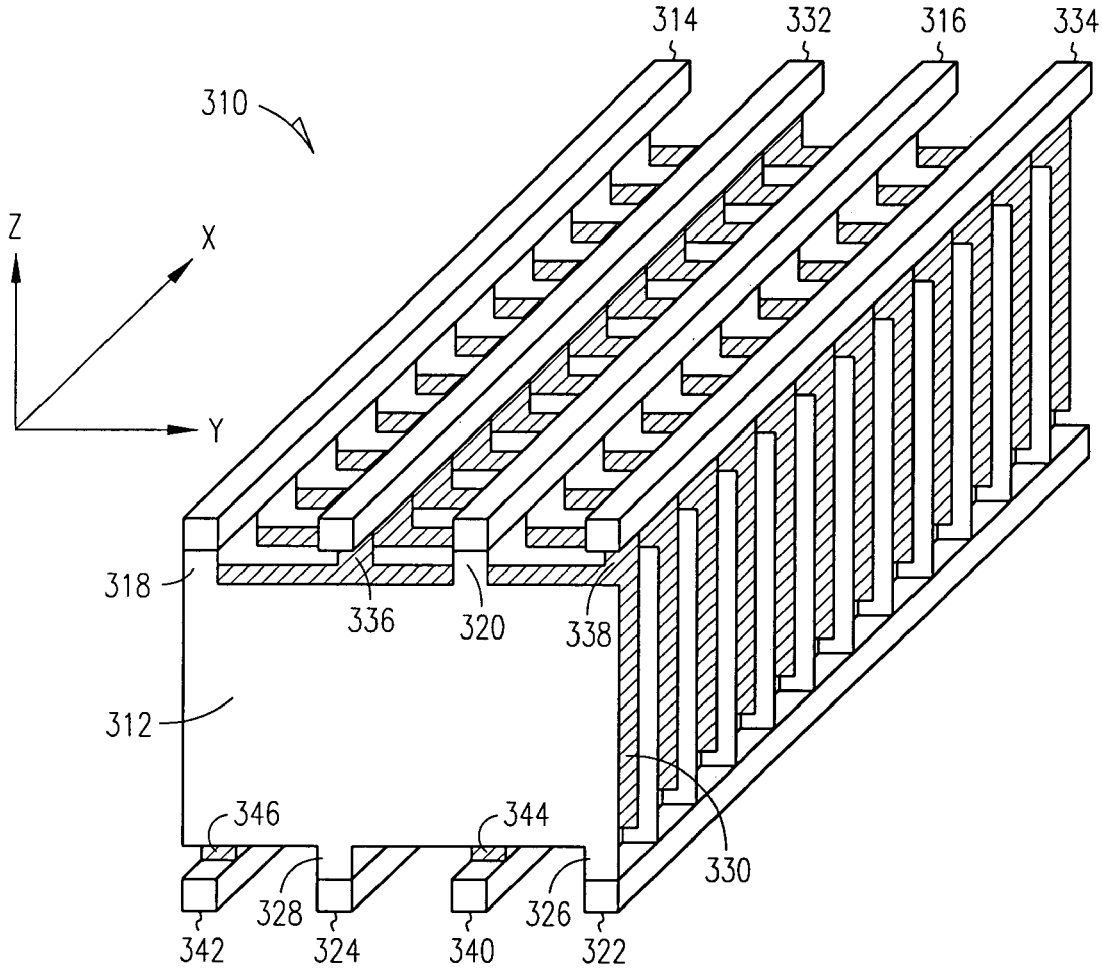
FIG. 3 is a perspective view of an inter-digital capacitor according to an embodiment.

FIG. 3 is a perspective view of an inventive inter-digital capacitor IDC 310 that is used in an embodiment of the invention. In this embodiment, a first capacitor plate 312 is assigned a power plate designation. First power capacitor plate 312 is connected to a first power connector 314, and a second power connector 316 at the top side thereof, and electrical connection is made by a first power tab 318 and a second power tab 320. At the bottom side thereof, first power capacitor plate 312 is connected to a third power connector 322, and a fourth power connector 324 at the bottom side thereof, and electrical connection is made by a third power tab 326 and a fourth power tab 328. By this configuration, first power tab 318 is most closely connected from the top to the bottom of IDC 310, diagonally across first power capacitor plate 312 to fourth power tab 328. This diagonal proximity may be referred to as a first polarity type.

A second capacitor plate 330 is assigned a ground plate designation. Second ground capacitor plate 330 is connected to a first ground connector 332, a second ground connector 334 at the top side thereof, and electrical connection is made by a first ground tab 336 and a second ground tab 338. At the bottom side thereof, second ground capacitor plate 330 is connected to a third ground connector 340, and a fourth ground connector 342 at the bottom side thereof, and electrical connection is made by a third ground tab 344 and a fourth ground tab 346. Accordingly the inventive IDC includes a series of alternating power and ground connectors on the top side and on the bottom side. The power and ground connectors are configured to make a connection with other structures such as an interposer on one side and a board on the other side.

It is noted that a plurality of alternating power and ground plates are depicted. According to an embodiment, the number of power and ground plates is in a range from about 4 to about 10,000 or more, depending upon the thickness of the plates and the totality of space in the X-dimension. In one embodiment, the number of power and ground plates is in a range from about 100 to about 2,000. In one embodiment, the number of power and ground plates is in a range from about 400 to about 800. In one embodiment, spacing between a given power capacitor plate and a given ground capacitor plate is in a range from about 0.1 mil to about 0.5 mils. In another embodiment, the spacing is about 0.3 mils.

A dielectric material (not pictured) is placed between first power capacitor plate 312 and second ground capacitor plate 330. In one embodiment, the dielectric material is silica. In one embodiment, the dielectric material is a low-K (meaning having a dielectric constant lower than that of silica) such as SiLK® made by Dow Chemical of Midland, Mich., or FLARE® made by AlliedSignal Inc. of Morristown, N.J.

Figure 4:
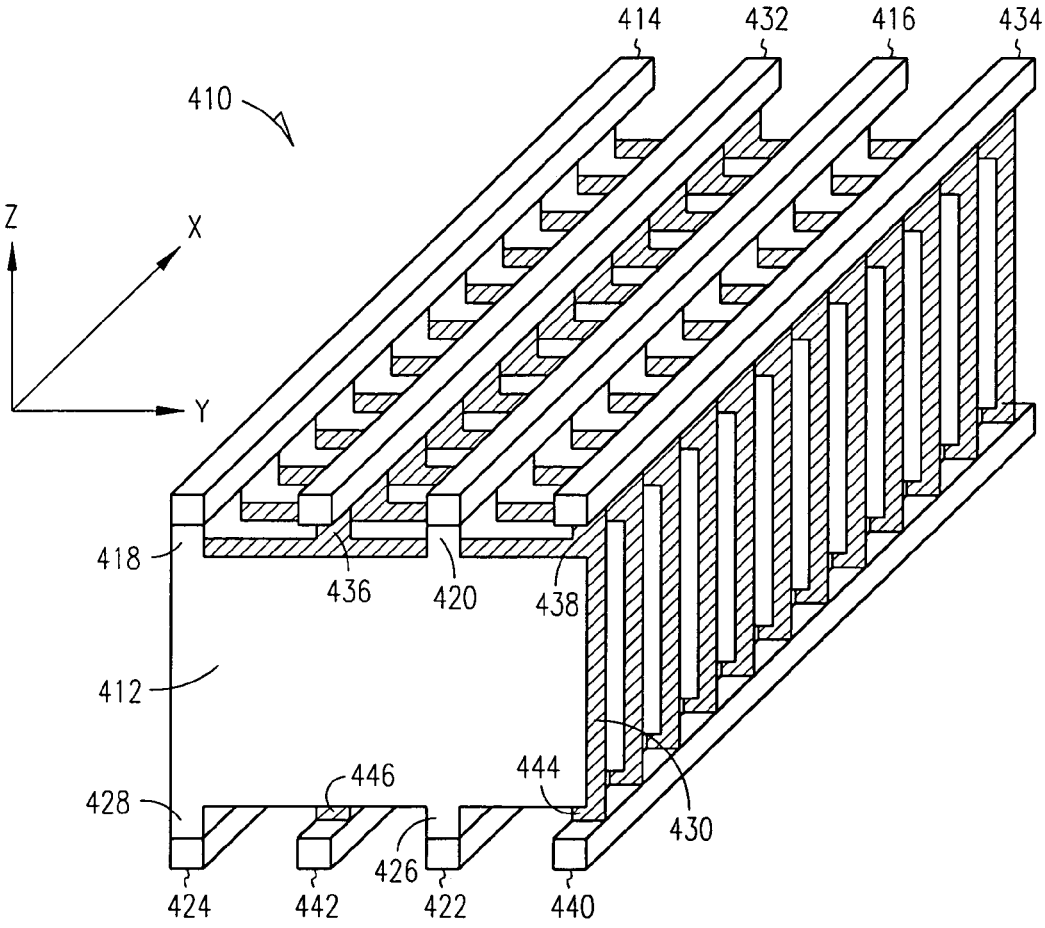
FIG. 4 is a perspective view of an inter-digital capacitor according to an embodiment.

FIG. 4 is a perspective view of another IDC 410 according to an embodiment. In this embodiment, a first capacitor plate 412 is assigned a power plate designation. First power capacitor plate 412 is connected to a first power connector 414, and a second power connector 416 at the top side thereof, and electrical connection is made by a first power tab 418 and a second power tab 420. At the bottom side thereof, first power capacitor plate 412 is connected to a third power connector 422, and a fourth power connector 424 at the bottom side thereof, and electrical connection is made by a third power tab 426 and a fourth power tab 428. By this configuration, first power tab 418 is most closely connected from the top to the bottom of IDC 410, substantially vertically across first power capacitor plate 412 to fourth power tab 428. This substantially vertical proximity may be referred to as a second polarity type.

A second capacitor plate 430 is assigned a ground plate designation. Second ground capacitor plate 430 is connected to a first ground connector 432, a second ground connector 434 at the top side thereof, and electrical connection is made by a first ground tab 436 and a second ground tab 438. At the bottom side thereof, second ground capacitor plate 430 is connected to a third ground connector 440, and a fourth ground connector 442 at the bottom side thereof, and electrical connection is made by a third ground tab 444 and a fourth ground tab 446.

It is noted that a plurality of alternating power and ground plates are depicted. According to an embodiment, the number of power and ground plates is in a range from about 2 to about 10,000 or more, depending upon the thickness of the plates and the totality of space in the X-dimension. Other ground and power capacitor plate number ranges are set forth herein. In one embodiment, spacing between a given power capacitor plate and a given ground capacitor plate is in a range from about 0.1 mil to about 0.5 mils. In another embodiment, the spacing is about 0.3 mils.

As set forth herein, a dielectric material (not pictured) is placed between first power capacitor plate 412 and second ground capacitor plate 430.

Figure 5:
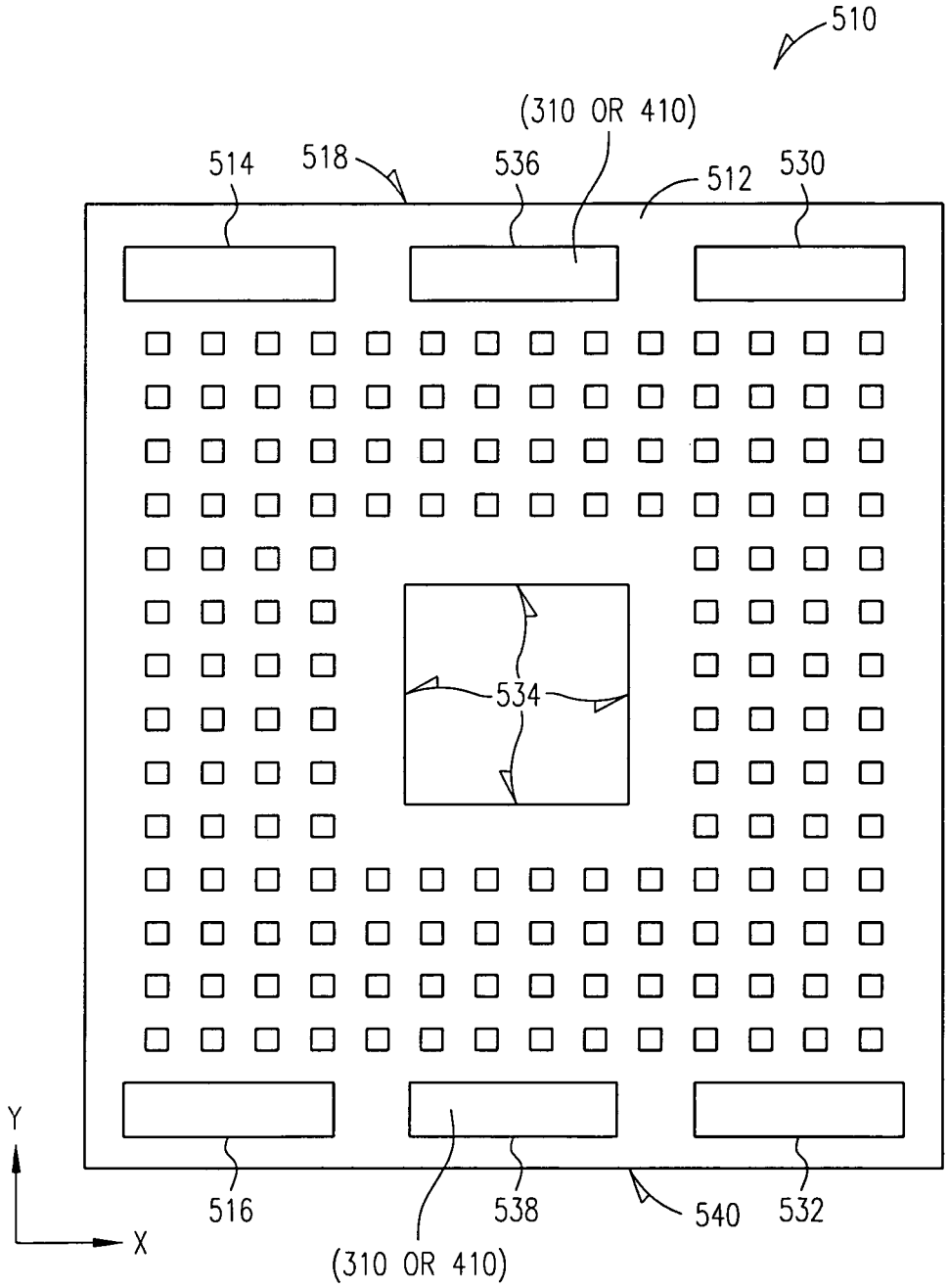
FIG. 5 is a top plan view of a high power socket according to an embodiment.

FIG. 5 depicts another embodiment in which the arrangement of power and ground terminals is rotated in relation to the vertical capacitors. A power socket 510 includes a first power terminal 514 embedded in a socket platform 512 and is spaced apart from a second power terminal 530 along an upper edge 518. Additionally, a first plurality of I/O sockets 524 is provided. The major planar surface of power socket 510 is depicted in the X-Y plane. A first ground terminal 516 and a second ground terminal 532 are spaced apart along a lower edge 540. In addition to the structure of power socket 510, a center space 534 is provided in one embodiment for a power capacitor for delivering short-range power to the electronic device. In this embodiment, center space 534 is provided for an LSC.

By this embodiment, current is also allowed to pass through a capacitor structure as illustrated generically by item 536. The capacitor structure 536 is disposed between the first power terminal 514 and the second power terminal 530. The capacitor structure 536 is oriented such that its capacitative surfaces (e.g. capacitor plates) are arranged orthogonal to the X-Y plane. In other words, the capacitor plates are vertically oriented to the major planar surface. In one embodiment, the capacitor structure 536 includes an inter-digital capacitor (illustrated in various embodiments in FIGS. 3 and 4). The inter-digital capacitor includes capacitor plates that are vertically (orthogonally) oriented to the major planar surface that is defined by the X-Y plane. Optionally and additionally, a second inter-digital capacitor 538 is disposed between the first ground terminal 516 and the second ground terminal 532 at the lower edge 540 of power socket 110. It is noted in FIG. 5 that the IDCs 310 or 410 may be used as an embodiment in the location of capacitors 536 and 538.

By recitation of these embodiments, it should be noted that the placement of both the power and ground terminals as well as the capacitor with vertically oriented capacitor plates, may be substantially anywhere on the socket platform 512 as well as for the embodiment of the socket platform 12 (FIG. 1, for terminals only) and platform 112 (FIG. 2A). However, where the I/O pin sockets 524 may be optimally located directly below the processor or other microelectronic device, the location of the power and ground terminals as well as the capacitor, in one embodiment, is along the periphery of the socket platform 512.

Figure 6:
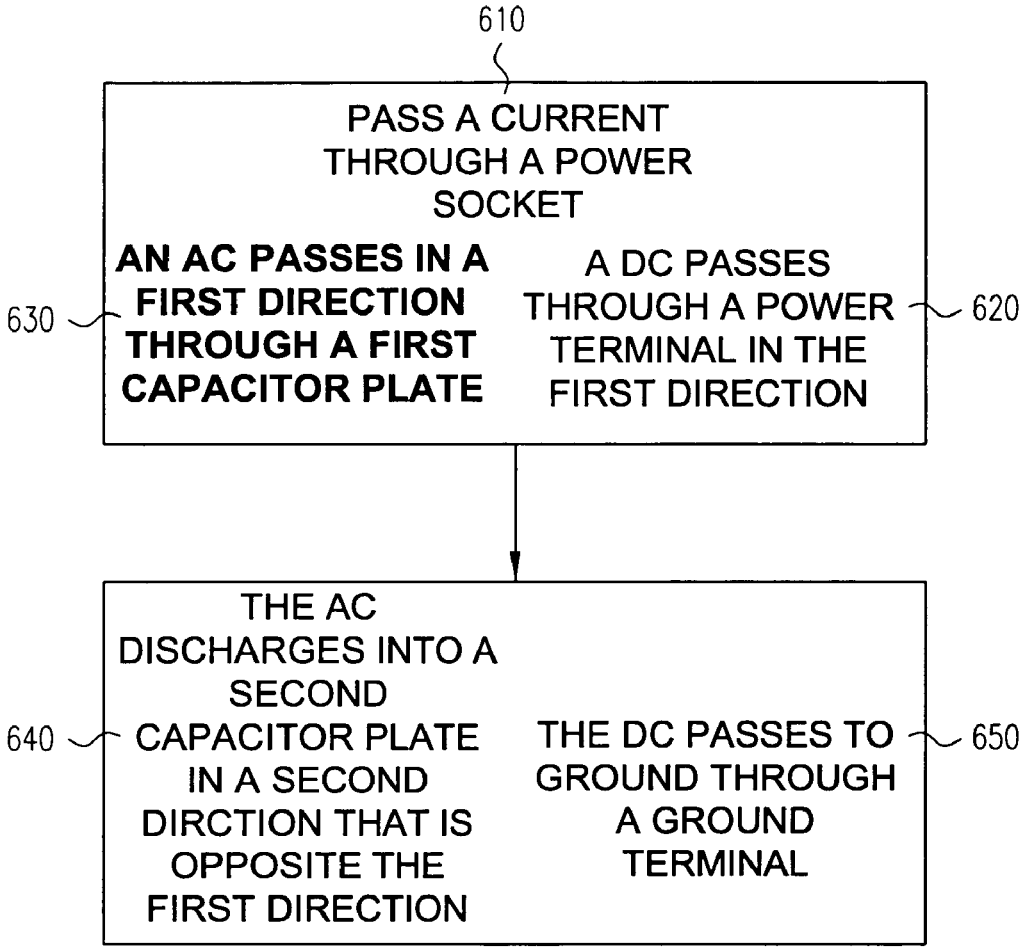
FIG. 6 is a method flow diagram according to an embodiment.

According to a method embodiment, a method of operating a device is depicted in FIG. 6. The method commences by passing 610 a current through a power socket. The current may include an alternating first current and a direct second current. The alternating first current passes 620 in a first direction through a first capacitor plate that is configured in a plane collinear with the first direction. The direct second current passes 630 in the first direction through a power terminal. At certain frequencies, the alternating first current discharges 640 into a second capacitor plate and conducts in a second direction that is substantially opposite to the first direction. For example, the frequency is in a range from about 1 GHz to about 10 GHz. As set forth herein, the second capacitor plate is spaced apart and immediately adjacent the first capacitor plate. Because of the proximity of the first and second capacitor plates and the vertical loop inductance, surrounded by the plurality of power and ground plates, results in an inductance in a range below about 0.1 pico Henry/square. In another embodiment, the inductance is from about 0.01 pico Henry/square to about 0.06 pico Henry/square. In another embodiment, the inductance is about 0.03 pico Henry/square. Further operations in the method include the direct second current passing to ground 650 through a ground terminal in the second direction. One advantage of this embodiment is that the overall impedance is reduced by the concerted presence of the power and ground terminal(s) and the vertically oriented capacitor(s).

The following is a method example. Reference may be made to the structure depicted in FIGS. 2A–2C. A DC current in the range from about 30 Ampere to about 200 Ampere passes through power terminals 14 and 30. An AC current in the range from about 10 milli Ampere to about 10 Ampere passes through the vertical capacitors 136 and 138 at a frequency of in a range from about 100 MHz to about 20 GHz. Total inductance in power socket 110 is in a range from about 0.1 picoHenry to about 10 picoHenry. Total resistance is in a range from about 2 milli Ohms to about 8 milli Ohms.

Figure 7:
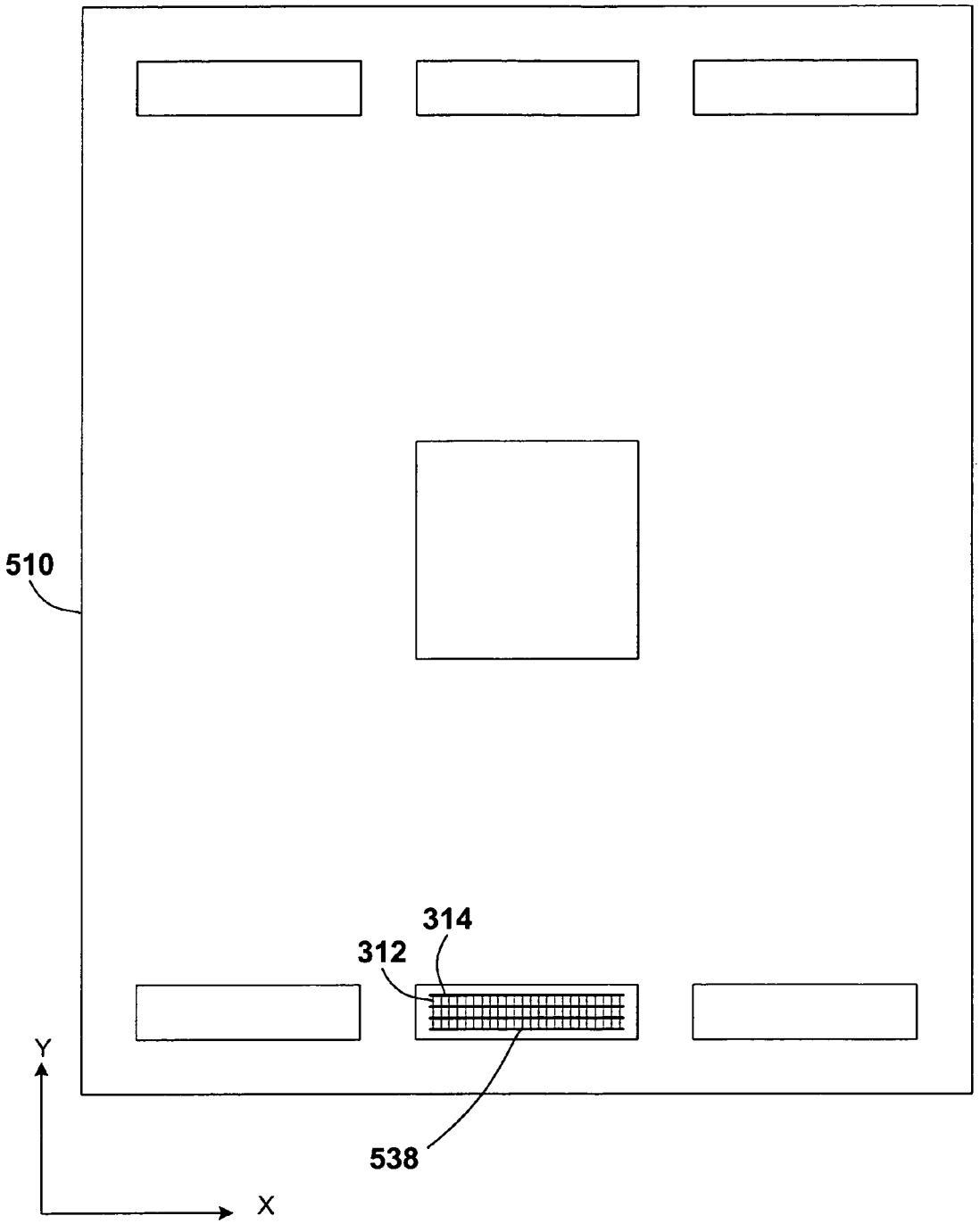
FIG. 7 is a top plan of the combination of elements from FIG. 3 and FIG. 5 according to an embodiment.

FIG. 7 is a top plan of the combination of elements from FIG. 3 and FIG. 5 according to an embodiment. The power socket 510 depicts the IDC 310, depicted in FIG. 3, inserted as the second interdigital capacitor 538 as indicated in FIG. 3 as "310 or 410".

It will be readily understood to those skilled in the art that various other changes in the details, material, and arrangements of the parts and method stages which have been described and illustrated in order to explain the nature of this invention may be made without departing from the principles and scope of the invention as expressed in the subjoined claims.

What is claimed is:

1. A power socket comprising:

a socket platform including a major planar surface; and on the socket platform:

a rectangular power terminal spaced apart from a rectangular ground terminal, wherein the power terminal includes a first cross-sectional area defined by a power terminal height by a power terminal width;

an input/output (I/O) pin socket, wherein the I/O pin socket includes a second cross-sectional area that is smaller than the first cross-sectional area; and a capacitor that has capacitor plates vertically oriented to the major planar surface.

2. A power socket comprising:

a socket platform including a major planar surface; and on the socket platform:

a rectangular power terminal spaced apart from a rectangular ground terminal, wherein the power terminal includes a first cross-sectional area defined by a power terminal height by a power terminal width;

an input/output (I/O) pin socket, wherein the I/O pin socket includes a second cross-sectional area that is smaller than the first cross-sectional area; and an inter-digital capacitor that has capacitor plates vertically oriented to the major planar surface.

3. A power socket comprising:

a socket platform including a major planar surface; and on the socket platform:

a rectangular power terminal spaced apart from a rectangular ground terminal, wherein the power terminal includes a first cross-sectional area defined by a power terminal height by a power terminal width;

an input/output (I/O) pin socket, wherein the I/O pin socket includes a second cross-sectional area that is smaller than the first cross-sectional area, wherein the socket platform includes a first edge and a second edge, wherein the power terminal includes two power terminals, wherein the ground terminal includes two ground terminals, wherein the two power terminals are symmetrically disposed along the first edge, wherein the two ground terminals are symmetrically disposed along the second edge; and a capacitor that is vertically oriented to the major planar surface and that is disposed between one of the power terminals and one of the ground terminals.

4. A power socket comprising:

a socket platform including a major planar surface; and on the socket platform:

a rectangular power terminal spaced apart from a rectangular ground terminal, wherein the power terminal includes a first cross-sectional area defined by a power terminal height by a power terminal width;

an input/output (I/O) pin socket, wherein the I/O pin socket includes a second cross-sectional area that is smaller than the first cross-sectional area, wherein the socket platform includes a first edge and a second edge, wherein the power terminal includes two power terminals, wherein the ground terminal includes two ground terminals, wherein the two power terminals are symmetrically disposed along the first edge, wherein the two ground terminals are symmetrically disposed along the second edge; and a capacitor that is vertically oriented to the major planar surface and that is disposed either between the two power terminals or the two ground terminals.

5. A power socket comprising:

a socket platform including a major planar surface; and on the socket platform:

a rectangular power terminal spaced apart from a rectangular ground terminal, wherein the power terminal includes a first cross-sectional area defined by a power terminal height by a power terminal width; and an input/output (I/O) pin socket, wherein the I/O pin socket includes a second cross-sectional area that is smaller than the first cross-sectional area, wherein the socket platform includes a first edge and a second edge;

wherein the power terminal includes a first power terminal and a second power terminal;

wherein the ground terminal includes a first ground terminal and a second ground terminal;

wherein the capacitor includes a first capacitor and a second capacitor;

wherein the first and second power terminals are symmetrically disposed along the first edge;

wherein the first and second ground terminals are symmetrically disposed along the second edge;

wherein the first and second capacitors are vertically oriented to the major planar surface;

wherein the first capacitor is disposed between the first power terminal and the first ground terminal; and wherein the second capacitor is disposed between the second power terminal and the second ground terminal.

6. A power socket comprising:

a socket platform including a major planar surface; and on the socket platform:

a rectangular power terminal spaced apart from a rectangular ground terminal, wherein the power terminal includes a first cross-sectional area defined by a power terminal height by a power terminal width; and an input/output (I/O) pin socket, wherein the I/O pin socket includes a second cross-sectional area that is smaller than the first cross-sectional area, wherein the socket platform includes a first edge and a second edge;

wherein the power terminal includes a first power terminal and a second power terminal;

wherein the ground terminal includes a first ground terminal and a second ground terminal;

wherein the capacitor includes a first capacitor and a second capacitor;

wherein the first and second power terminals are symmetrically disposed along the first edge;

wherein the first and second ground terminals are symmetrically disposed along the second edge;

wherein the first and second capacitors are vertically oriented to the major planar surface;

wherein the first capacitor is disposed between the first power terminal and the second power terminal; and wherein the second capacitor is disposed between and the first ground terminal and the second ground terminal.

7. A power socket comprising:

a socket platform including a major planar surface; and on the socket platform:

a rectangular power terminal spaced apart from a rectangular ground terminal, wherein the power terminal includes a first cross-sectional area defined by a power terminal height by a power terminal width;

an input/output (I/O) pin socket, wherein the I/O pin socket includes a second cross-sectional area that is smaller than the first cross-sectional area and a capacitor that has capacitor plates vertically oriented to the major planar surface, and wherein the capacitor includes an inter-digital capacitor of a first polarity type.

8. A power socket comprising:

a socket platform including a major planar surface; and on the socket platform:

a rectangular power terminal spaced apart from a rectangular ground terminal, wherein the power terminal includes a first cross-sectional area defined by a power terminal height by a power terminal width;

an input/output (I/O) pin socket, wherein the I/O pin socket includes a second cross-sectional area that is smaller than the first cross-sectional area; and a capacitor that has capacitor plates vertically oriented to the major planar surface, and wherein the capacitor includes an inter-digital capacitor of a second polarity type.

9. A power socket comprising:

a major planar upper surface and a major planar lower surface;

a rectangular power terminal spaced apart from a rectangular ground terminal, wherein the power terminal includes a first cross-sectional area defined by a power terminal height by a power terminal width;

a first plurality of input/output (I/O) pin sockets disposed at the major planar upper surface, wherein I/O pin socket of the plurality of I/O pin sockets includes a second cross-sectional area that is smaller than the first cross-sectional area;

a capacitor that has capacitor plates vertically oriented to the major planar surface; and a second plurality of electrical bumps disposed at the major planar lower surface.

10. The power socket according to claim 9, wherein the second plurality of electrical bumps equals the first plurality of I/O pin sockets.

11. The power socket according to claim 9, wherein the capacitor includes an inter-digital capacitor.

12. The power socket according to claim 9, wherein the socket platform includes a first edge and a second edge, wherein the power terminal includes two power terminals, wherein the ground terminal includes two ground terminals, wherein the two power terminals are symmetrically disposed along the first edge, and wherein the two ground terminals are symmetrically disposed along the second edge.

13. The power socket according to claim 9, wherein the socket platform includes a first edge and a second edge, wherein the power terminal includes two power terminals, wherein the ground terminal includes two ground terminals, wherein the two power terminals are symmetrically disposed along the first edge, wherein the two ground terminals are symmetrically disposed along the second edge; and wherein the capacitor includes a first and a second inter-digital capacitor that are vertically oriented to the major planar surface, and wherein the first inter-digital capacitor is disposed between one of the power terminals and one of the ground terminals.

14. A power socket comprising:

a plurality of input/output (I/O) pin sockets embedded in a socket platform, herein the socket platform includes a major planar surface;

a first power terminal embedded in the socket platform;

a ground terminal embedded in the socket platform;

a capacitor embedded in the socket platform, wherein the capacitor includes a power plate and a ground plate, and wherein the power plate and the ground plate are configured orthogonal to the major planar surface, wherein the capacitor includes an inter-digital configuration including a plurality of power and ground plates, and the capacitor further including:

a series of alternating power and ground connectors disposed orthogonal to the power and ground plates.

15. A power socket comprising:

a plurality of input/output (I/O) pin sockets embedded in a socket platform, wherein the socket platform includes a major planar surface;

a first power terminal embedded in the socket platform;

a ground terminal embedded in the socket platform, and a capacitor embedded in the socket platform, wherein the capacitor includes a power plate and a ground plate, wherein the power plate and the ground plate are configured orthogonal to the major planar surface, and wherein the capacitor includes an inter-digital configuration including a plurality of power and ground plates, and the capacitor further including:

a series of four alternating power and ground connectors disposed orthogonal to the power and ground plates on a first side of the capacitor; and a series of four alternating power and ground connectors disposed orthogonal to the power and ground plates on a second side of the capacitor, wherein the second side is opposite the first side.

16. A power socket comprising:

a plurality of input/output (I/O) pin sockets embedded in a socket platform, wherein the socket platform includes a major planar surface;

a first power terminal embedded in the socket platform;

a ground terminal embedded in the socket platform; and a capacitor embedded in the socket platform, wherein the capacitor includes a power plate and a ground plate, wherein the power plate and the ground plate are configured orthogonal to the major planar surface, and wherein the capacitor includes an inter-digital configuration including a plurality of power and ground plates, and the capacitor further including:

a series of four alternating power and ground connectors disposed orthogonal to the power and ground plates on a first side of the capacitor; and a series of four alternating ground and power connectors disposed orthogonal to the power and ground plates on a second side of the capacitor, wherein the second side is opposite the first side, and wherein a given power connector on the first side is aligned opposite a given ground connector on the second side.

17. A power socket comprising:

a plurality of input/output (I/O) pin sockets embedded in a socket platform, wherein the socket platform includes a major planar surface;

a first power terminal embedded in the socket platform;

a ground terminal embedded in the socket platform; and a capacitor embedded in the socket platform, wherein the capacitor includes a power plate and a ground plate, wherein the power plate and the ground plate are configured orthogonal to the major planar surface, wherein the socket platform includes a first edge and a second edge that are parallel with the major planar surface, further including a second power terminal, wherein the ground terminal includes two ground terminals, wherein the first and second power terminals are symmetrically disposed along the first edge, and wherein the two ground terminals are symmetrically disposed along the second edge.

18. A power socket comprising:

a plurality of input/output (I/O) pin sockets embedded in a socket platform, wherein the socket platform includes a major planar surface;

a first power terminal embedded in the socket platform;

a ground terminal embedded in the socket platform; and a capacitor embedded in the socket platform, wherein the capacitor includes a power plate and a ground plate, wherein the power plate and the ground plate are configured orthogonal to the major planar surface, wherein the socket platform includes a first edge and a second edge that are parallel with the major planar surface, further including a second power terminal, wherein the ground terminal includes two ground terminals, wherein first and second power terminals are symmetrically disposed along the first edge, wherein the two ground terminals are symmetrically disposed along the second edge; and wherein the capacitor that is vertically oriented to the major planar surface is disposed between one of the power terminals and one of the ground terminals.

19. A power socket comprising:

a plurality of input/output (I/O) pin sockets embedded in a socket platform, wherein the socket platform includes a major planar surface;

a first power terminal embedded in the socket platform;

a ground terminal embedded in the socket platform; and a capacitor embedded in the socket platform, wherein the capacitor includes a power plate and a ground plate, wherein the power plate and the ground plate are configured orthogonal to the major planar surface, wherein the socket platform includes a first edge and a second edge that are parallel with the major planar surface, wherein the power terminal includes two power terminals, wherein the ground terminal includes two ground terminals, wherein the two power terminals are symmetrically disposed along the first edge, wherein the two ground terminals are symmetrically disposed along the second edge; and wherein the capacitor that is vertically oriented to the major planar surface and is disposed either between the two power terminals or the two ground terminals.

* * * * *

UNITED STATES PATENT AND TRADEMARK OFFICE

CERTIFICATE OF CORRECTION

PATENT NO. : 6,964,584 B2
DATED : November 15, 2005
INVENTOR(S) : Zhong et al.

It is certified that error appears in the above-identified patent and that said Letters Patent is hereby corrected as shown below:

Column 9,
Line 62, after "platform" delete "," and insert -- ; --.

Signed and Sealed this

Twenty-fifth Day of April, 2006

JON W. DUDAS
*Director of the United States Patent and Trademark Office*